United States Patent [19]

Gustafsson

[11] 4,209,914

[45] Jul. 1, 1980

[54] METHOD AND DEVICE FOR DRYING MACHINE PARTS

[75] Inventor: Berth U. Gustafsson, Österskär, Sweden

[73] Assignee: Projectus Industriprodukter Aktiebolag, Bromma, Sweden

[21] Appl. No.: 859,140

[22] Filed: Dec. 9, 1977

[30] Foreign Application Priority Data

Dec. 10, 1976 [SE] Sweden ..... 7613929

[51] Int. Cl.[2] ..... F26B 3/04

[52] U.S. Cl. ..... 34/27; 34/32; 34/77; 266/156; 266/901

[58] Field of Search ..... 266/156, DIG. 901; 34/5, 27, 32, 51, 76, 77, 73, 74, 75, 57 E, 104, 156, 169, 174, 92, 224, 225; 432/99, 96

[56] References Cited

U.S. PATENT DOCUMENTS

| | | | |
|---|---|---|---|
| 2,746,168 | 5/1956 | Rickabaugh | 34/51 |
| 3,010,216 | 11/1961 | Ravet | 34/92 |
| 4,053,990 | 10/1977 | Bielinski | 34/92 |
| 4,166,305 | 9/1979 | Gustafsson | 134/199 |

FOREIGN PATENT DOCUMENTS

| | | | |
|---|---|---|---|
| 443788 | 5/1927 | Fed. Rep. of Germany | 34/78 |
| 1051440 | 9/1953 | France | 432/99 |
| 914390 | 1/1963 | United Kingdom | 34/36 |

*Primary Examiner*—Larry I. Schwartz

*Attorney, Agent, or Firm*—Birch, Stewart, Kolasch & Birch

[57] ABSTRACT

A method and a device for drying machine parts, e.g. balls or rolls for roller bearings, upon washing the parts in a washing liquid containing a solvent, especially a polluting solvent. Upon washing, the wet parts are fed into a chamber, and a dry, hot gas is injected into the chamber and evacuated therefrom. The evacuated humid gas is recirculated in a circuit and, upon being compressed and cooled, the gas is freed from its solvent contents in a liquid separator and is heated before re-injection into the chamber. A reduced gas pressure is maintained in the chamber by controlling the gas flow in the recirculation circuit, and the gas in the chamber is cooled, so that the partial pressure of the solvent in the chamber is substantially reduced.

14 Claims, 5 Drawing Figures

METHOD AND DEVICE FOR DRYING MACHINE PARTS

BACKGROUND OF THE INVENTION

The present invention relates to a method and a device for drying machine parts, e.g. balls or rolls for roller bearings, upon washing the parts with a washing liquid containing a solvent.

Many of the most effective solvents being used today for degreasing and cleaning machine-finished parts are enviromentally harmful and medically perilous. Thus, e.g. chlorinated hydrocarbons, such as tri- and perchloroethylene are speculated to cause cancer. Therefore, the washing operation as well as the following drying process must be effected in such a way that solvent vapor is not spread into the environment, except for very small quantities, so that given limit values are not exceeded.

SUMMARY OF THE INVENTION

An object of the present invention is to provide a drying method enabling the safe use of such solvents and additionally, offering further advantages, such as low installation and operational costs and low energy consumption.

This object is achieved by following the method and using the device, according to the present invention. Upon washing, the wet parts are fed into a chamber and a dry, hot gas is injected into the chamber and evacuated therefrom. The evacuated humid gas is recirculated in a circuit and, upon being compressed and cooled, the gas is freed from its solvent contents in a liquid separator and is heated before re-injection into the chamber. The improvement comprises the maintenance of a reduced gas pressure in the chamber by controlling the gas flow in the recirculation circuit, the gas in the chamber being cooled, so that the partial pressure of the solvent in the chamber is substantially reduced.

The drying method according to the present invention is not only useful for polluting solvents but also for the drying of parts having been washed with any kind of washing liquid, e.g. white spirit.

The invention is described further below with reference to the drawings illustrating a preferred embodiment thereof.

DESCRIPTION OF AN EXEMPLARY EMBODIMENT

Figure 1:
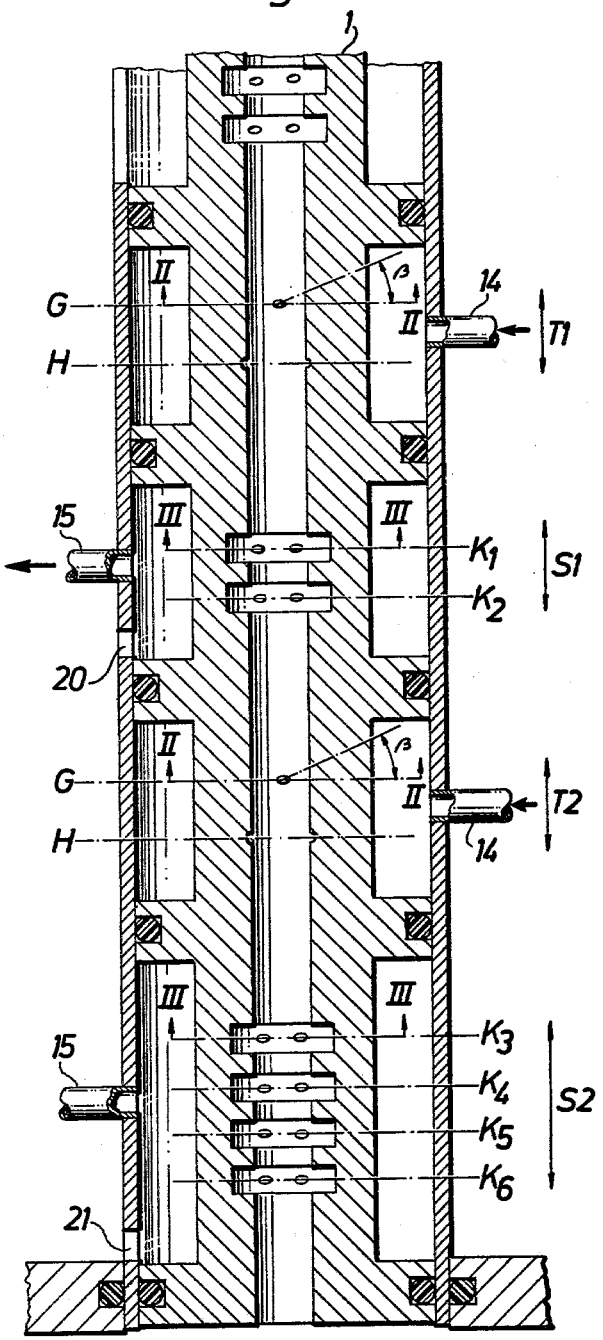
FIG. 1 is a longitudinal section through the drying part of a combined washing and drying apparatus.
Figure 4:
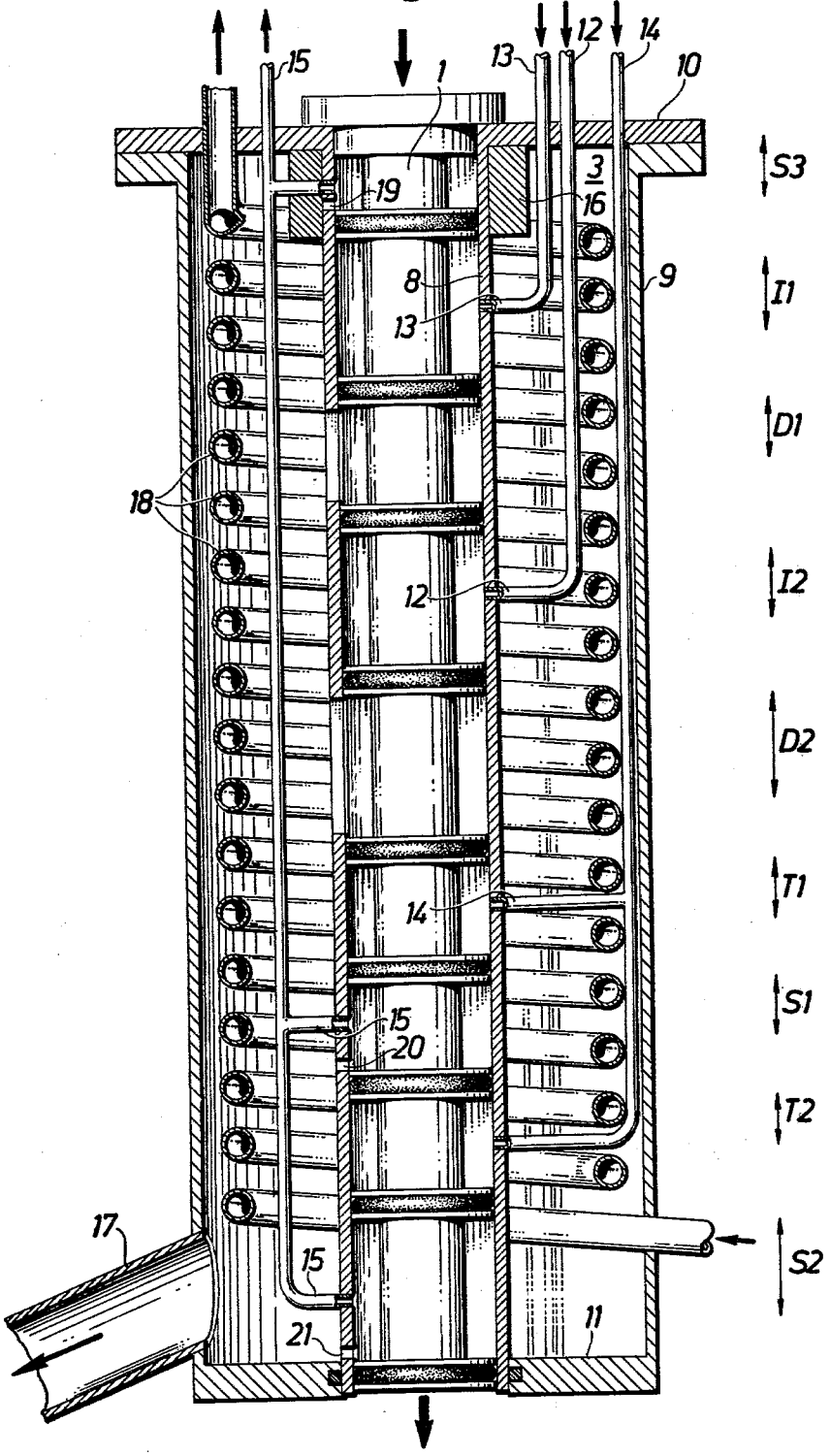
FIG. 4 is a longitudinal section through said combined washing and drying apparatus.

FIG. 1 shows the drying part of an apparatus, shown in total in FIG. 4, for washing and drying machine details, especially balls or rolls for roller bearings.

The balls or rolls are fed, one after the other, through a cylindrical tube 1, and upon washing in a solvent, the wet ball or rolls enter from above, the tube portion shown in FIG. 1. Dry hot air is blown through nozzles 2G and 2H, which are disposed in the tube wall and directed essentially in a tangential direction, seen in a plane normal to the tube axis, and inclined by an angle $\beta$, in the order of 10°–80°, preferably 30°, relative to said plane normal to the tube axis, i.e. the feed direction of the ball or roll.

Figure 2:
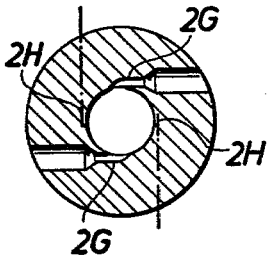
FIG. 2 and 3 are cross sections taken along the lines II—II and III—III, respectively, in FIG. 1.

The nozzles 2G, 2H are suitably disposed in pairs in a number of, preferably two, successive planes G and H (see FIG. 1) and equally distributed circumferentially (see FIG. 2) so as to cause a symmetrical, helical air current within the tube 1.

Figure 3:
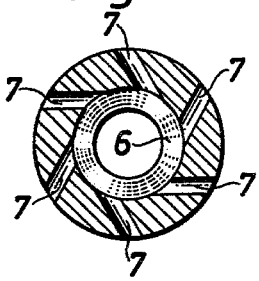
Figure 5:
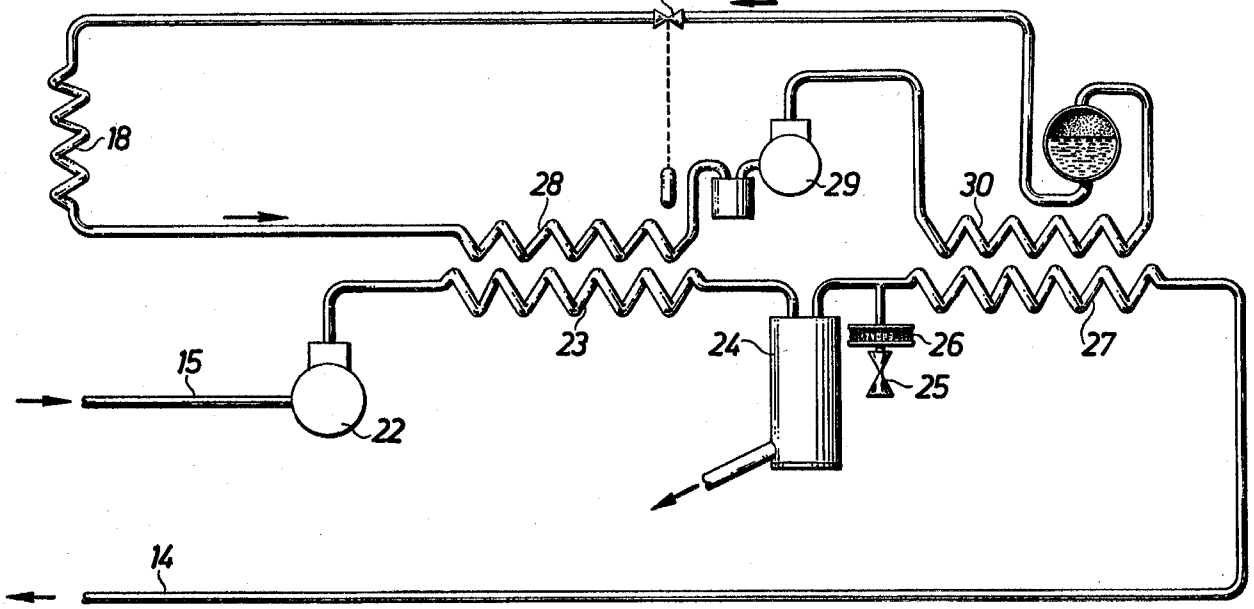
FIG. 5 illustrates a re-circulation circuit for the drying gas and a refrigeration circuit in co-operation therewith.

A number of suction holes 7 are arranged in the tube wall at a certain axial distance from the injection nozzles 2G, 2H to secure a good drying effect, said suction holes communicating with an exhaust conduit shown in FIG. 5. The suction holes 7 are connected to annular grooves 6 formed in the tube wall and are equally distributed circumferentially (see FIG. 3) in a number of, preferably two, successive planes $K_1$, $K_2$ and are tangentially oriented in opposite direction as compared to the nozzles 2G, 2H, thereby permitting the rotating air to flow through the suction holes 7 at minimal resistance.

As will be seen from FIG. 1 and 4, the apparatus is provided with two successive drying portions each having corresponding injection and exhaust sections T1, S1 and T2, S2, respectively. These drying portions are basically similar, but the last exhaust section S2 comprises, for increased safety, more (namely four) sets of suction holes (in the planes $K_3$–$K_6$) than the first-mentioned exhaust section S1 being provided with two such sets. The inlet end of the tube 1 (see FIG. 4) is additionally provided with an exhaust section S3, in order to prevent air, which has possibly flown backwards and passed the preceding washing portions, from escaping the environment but to be exhausted in the same way as in the exhaust sections S1 and S2.

The wet(at the top of FIG. 1) ball or roll being fed through the tube will, consequently, be dried effectively in two steps by the helical hot air flow in the respective drying portions.

In order to prevent air containing any kind of solvents from escaping through the open end of the tube 1, a reduced pressure is permanently maintained within the tube 1 and, suitably, also within the enclosing chamber (compare FIG. 4). As will be clear from the description below, this is achieved by keeping the total air flow injected through the injection nozzles 2 lower than the total air flow exhausted from the exhaust holes 7.

The preferred embodiment, shown in FIG. 4, of the device according to the present invention also comprises two washing portion I1, D1 and I2, D2, respectively, at the upper part of the tube 1, wherein a solvent is injected under pressure into an injection section I1, I2, respectively, and drained in a drain section D1, D2, respectively. This part of the device, intended for washing, has been described more fully in the Swedish patent specification 7613928-6. Thus, the device comprises an inner casing 8 enclosing the tube 1, an outer casing 9 defining a casing chamber 3, upper and lower end flanges 10 and 11, respectively, connection conduits 12,13 for fresh and re-circulated washing liquid, respectively, connection conduits 14, 15 for injecting dry hot air and exhausting humid air, respectively, a coil 16 for generating an alternating magnetic field to demagnetize, before washing, particles magnetically bound to the surface of the ball or roll, a lower drain pipe 17 for used washing liquid, and a refrigeration coil 18 arranged between the casings 8,9.

Furthermore, the device is gas-proof, and the purpose of the refrigeration coil 18 disposed in the casing chamber 3 inside the casing 8–11 is to reduce the vapor pressure and, consequently, the risk of leakage of solvent vapor.

The injected hot air flow contains a rather large quantity of heat energy and, therefore, the exhausted, wet air is re-circulated in a circuit shown in FIG. 5.

From the exhaust conduit 15, which communicates with the exhaust holes 7 in the tube 1 (see also FIGS. 1 and 4), the air is drawn into an air compressor 22, from which the air is blown sequentially through an air cooler 23, a liquid separator 24 (from which the solvent-condensate is preferably returned to a collecting tank for used solvent), past a branch conduit containing an adjustable throttle 25 (possibly consisting of a throttle valve communicating freely with the environment and, therefore, preferably having a filter 26 connected in series therewith for collecting possible solvent remainders, which have not been separated in the liquid separator), and through an air heater 27, before the air is again injected into the tube 1 via said connection conduit 14 and the nozzles 2.

Cooling and heating the air is suitably effected according to the heat pump principle, as shown in FIG. 5. A special refrigeration circuit has its vaporizer 28 disposed adjacent to the air cooler 23 and, thus, absorbs heat from the air flowing therethrough. The vaporized refrigeration fluid is pumped by a compressor 29 to a condensor 30, where the absorbed heat is returned to the air flowing through the heater 27. After condensating, the refrigeration fluid flows via a throttle means 31 through said cooling coil 18 in the casing chamber 3 enclosing the tube 1 before reaching the vaporizer 28 again.

Thanks to the throttle valve 25 communicating with the ambient air and constituting a controlled air leakage in the air circuit on the pressure side of the compressor, the total injection air flow will be lower than the total air flow being exhausted from the tube 1 and, therefore, because of the openings 19, 20 and 21 shown in FIG. 4, a reduced pressure is maintained in the tube 1 and also in the enclosing casing chamber 3.

Thus, hereby the risk for the escape of solvent vapor into the ambient air is very small and, therefore, also dangerous solvents can be used without any risk. A minor leakage in the casing of the device is of no importance in this respect, since the pressure is low and also the partial pressure of the solvent vapor is kept very low due to the cooling.

Furthermore, the method and the device according to the invention facilitate a very energy-saving operation, and for this reason the invention may advantageously be used also for other kinds of solvents, e.g. white spirit or the like.

Naturally, the invention may be worked in many different ways within the scope of the following claims. Thus, e.g. the shape of the chamber is of secondary importance, and the drying of large batches of machine parts is also envisaged, in which case the batch is placed in an open container, such as a basket or the like, which is inserted into the drying chamber. Of course, it is essential to maintain a low pressure in the chamber by re-circulating the drying gas and providing a controlled gas flow in the re-circulation circuit.

I claim:

1. An improved method for drying machine parts which have been washed with a washing liquid containing a solvent, comprising the steps of feeding the wet machine parts into a chamber, injecting dry, hot gas into the chamber and evacuating humid gas therefrom, the evacuated, humid gas being recirculated in a circuit and, upon being compressed and cooled, freed from its solvent contents in a liquid separator, and heated before re-injection into the chamber, the improvement comprising reducing the total gas pressure in the chamber by controlling the gas flow in said recirculation circuit, and reducing the partial pressure of the solvent in the chamber by cooling the gas in said chamber.

2. The method as defined in claim 1, wherein the reduced gas pressure in the chamber is maintained by a controlled discharge of a small portion of the recirculating gas from the pressure side of the recirculation circuit.

3. The method as defined in claim 1, wherein the recirculated gas is cooled and heated by means of a refrigeration circuit which withdraws heat from the humid gas, and after removal of the solvent therefrom, returns heat to the dry gas.

4. The method as defined in claim 3, wherein the refrigeration circuit contains a throttle means and a vaporizer and the refrigeration fluid in the refrigeration circuit is fed through a refrigeration coil connected between said throttle means and said vaporizer of the refrigeration circuit, said coil enclosing said chamber.

5. The method as defined in claim 1, wherein the drying process is performed in the same chamber as the washing process.

6. The method as defined in claim 1 for the drying of machine parts in the form of balls or rolls having a finely worked external surface, wherein the machine parts are fed one after the other through a cylindrical tube chamber having at least one drying zone, said hot gas being injected into said drying zone in a direction such as to cause a rotating helical gas flow, and the gas being evacuated at least on one side, seen in the feed direction, of said drying zone.

7. The method as defined in claim 6, wherein the hot gas is injected substantially tangentially, as seen in a plane normal to the tube axis.

8. In an apparatus for drying machine parts including a chamber for inserting machine parts to be dried after washing the same with a washing liquid containing a solvent, injection means for injection of dry, hot gas into the chamber, evacuation means for evacuating humid gas from the chamber, and a recirculation circuit connected between said evacuation means and said injection means, said recirculation circuit having a gas compressor, a gas cooler, a liquid separator for the separation of condensed solvent and a gas heater, the improvement which comprises a discharge branch for the controlled discharge of a small portion of the recirculating gas from the pressure side of the recirculation circuit, and cooling means for cooling the gas in the chamber.

9. The apparatus as defined in claim 8, comprising a refrigeration circuit cooperating with the recirculation circuit, said refrigeration circuit containing a vaporizer for withdrawing heat from the humid gas and a condenser for transferring heat to the dry gas.

10. The apparatus as defined in claim 9, wherein the refrigeration circuit further contains a throttle means and a refrigeration coil, said refrigeration coil being connected between the throttle means and the vaporizer, said refrigeration coil enclosing said chamber.

11. The apparatus as defined in claim 7, wherein one chamber is used for washing and drying the machine parts.

12. The apparatus as defined in claim 8 for the drying of machine parts in the form of balls or rolls having a finely worked external surface, wherein the chamber is defined by a cylindrical tube having at least one drying zone, said injection means comprising at least two nozzles in said drying zone, said nozzles being directed so as to cause a rotating helical gas flow in the tube, and said evacuation means comprising evacuation openings disposed on at least one side, seen in the feed direction of the machine parts, of the drying zone.

13. The apparatus as defined in claim 12, wherein the injection nozzles, as seen in a plane normal to the tube axis, are directed substantially tangentially at the inner cylindrical surface of the tube.

14. The apparatus of claim 13 wherein the evacuation means comprises a plurality of suction channels and an annular groove formed in the tube wall, said suction channels communicating with the annular groove.

* * * * *